US008337107B2

(12) United States Patent
Ohsawa et al.

(10) Patent No.: US 8,337,107 B2
(45) Date of Patent: Dec. 25, 2012

(54) MECHANICAL PENCIL

(75) Inventors: Norio Ohsawa, Yokohama (JP); Takeo Fukumoto, Yokohama (JP); Yoshitoshi Osano, Yokohama (JP); Takeshi Kobayashi, Yokohama (JP); Hirotake Izawa, Yokohama (JP); Kyo Nakayama, Yokohama (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 357 days.

(21) Appl. No.: 12/866,943

(22) PCT Filed: Dec. 18, 2008

(86) PCT No.: PCT/JP2008/073050

§ 371 (c)(1),
(2), (4) Date: Aug. 10, 2010

(87) PCT Pub. No.: WO2009/118965

PCT Pub. Date: Oct. 1, 2009

(65) Prior Publication Data

US 2010/0322695 A1 Dec. 23, 2010

(30) Foreign Application Priority Data

Mar. 26, 2008 (JP) ..... 2008-080333

(51) Int. Cl.
*B43K 21/22* (2006.01)

(52) U.S. Cl. ..... 401/93; 401/92

(58) Field of Classification Search ..... 401/92–94
See application file for complete search history.

(56) References Cited

U.S. PATENT DOCUMENTS 4,650,359 A * 3/1987 Sakaoka ..... 401/53
(Continued)

FOREIGN PATENT DOCUMENTS

JP 8-072473 A 3/1996
(Continued)

OTHER PUBLICATIONS

International Search Report of PCT/JP2008/073050, Mailing Date of Feb. 3, 2009.

*Primary Examiner* — David Walczak
*Assistant Examiner* — Jennifer C Chiang
(74) *Attorney, Agent, or Firm* — Westerman, Hattori, Daniels & Adrian, LLP

(57) ABSTRACT

A writing lead (10) is grasped and released by reciprocation of a chuck (3) provided in a body cylinder (1) so as to inch the writing lead forward and a rotational drive mechanism is provided for rotationally driving a rotor (5) in one direction in conjunction with retreat operation by the writing pressure applied to the writing lead and forward movement by releasing the writing pressure. A pipe support member (8) for supporting a pipe end (7) is accommodated in a base (1A) which constitutes a front end portion of the body cylinder, and a retreat drive mechanism is provided for gradually retreating the pipe support member into the body cylinder in conjunction with rotational drive operation of the rotor. With the above-mentioned structure, a pipe-slide type mechanical pencil can maintain an amount of projection of the writing lead from the pipe end within a certain range.

12 Claims, 11 Drawing Sheets

U.S. PATENT DOCUMENTS

| | | | | | |
|---|---|---|---|---|---|
| 4,884,910 | A * | 12/1989 | Kageyama et al. | ..... | 401/65 |
| 7,654,763 | B2 * | 2/2010 | Izawa et al. | ..... | 401/93 |
| 7,802,936 | B1 * | 9/2010 | Izawa et al. | ..... | 401/93 |
| 7,806,615 | B1 * | 10/2010 | Izawa et al. | ..... | 401/93 |
| 7,815,385 | B2 * | 10/2010 | Izawa et al. | ..... | 401/93 |
| 7,850,380 | B2 * | 12/2010 | Izawa et al. | ..... | 401/93 |
| 7,850,381 | B2 * | 12/2010 | Izawa et al. | ..... | 401/93 |

FOREIGN PATENT DOCUMENTS

| | | | |
|---|---|---|---|
| JP | 8-132782 | A | 5/1996 |
| JP | 11-099795 | A | 4/1999 |
| JP | 2002-356092 | A | 12/2002 |
| WO | 2007-142135 | A1 | 12/2007 |

* cited by examiner (A)

(B)

(C)

(D)

(E)

MECHANICAL PENCIL

TECHNICAL FIELD

The present invention relates to a mechanical pencil in which a writing lead can be caused to project from a base by knock operation and a pipe-like lead guide arranged at the above-mentioned base can be retreated according to abrasion of the writing lead while the writing proceeds.

BACKGROUND ART

Conventionally, a pipe-like lead guide is attached and fixed to a base in a mechanical pencil. According to this structure, if an amount of projection of the writing lead projecting from a lead guide is large, breakage of the lead (lead breakage) may occur when writing. Thus, it is necessary to limit a projection length of the lead which projects from a lead guide by one knock operation.

For this reason, according to consumption of the lead due to the writing operation, we are obliged to frequently carry out knock operation for a knock bar provided at a rear end portion of a lead storage. In other words, there is a problem in that having to change a grip and to perform the knock operation when writing reduces writing efficiency.

Then, for example, patent documents 1 and 2 etc. below propose and disclose a pipe-slide type mechanical pencil which operates such that, as the writing lead projects due to the knock operation, a pipe-like lead guide also moves forward; as the lead is abraded while the writing proceeds, the lead guide may also retreat.

Patent Document 1: Japanese Patent Application Publication No. H8-072473

Patent Document 2: Japanese Patent Application Publication No. H8-132782

DISCLOSURE OF THE INVENTION

Object of the Invention

According to the pipe-slide type mechanical pencil disclosed in patent documents 1 and 2 above, it operates so that the above-mentioned lead guide may retreat gradually, when a tip portion of the pipe-like lead guide comes into contact with a paper surface due to the abrasion of the lead while the writing proceeds. Thus, if the amount of projection of the lead projecting from the base by one knock operation is set to be somewhat large, the writing lead is protected by the pipe-like lead guide and can reduce a frequency of breaking the lead while the writing proceeds.

However, according to the pipe-slide type mechanical pencil disclosed in patent documents 1 and 2, since the writing lead is abraded while the writing proceeds, the tip portion of the lead guide formed of a metal, such as for example stainless steel, slides on the paper surface. Therefore, there arises a problem that a feeling of writing is worsened because of friction resistance at this time, or in an extreme case, a tip portion edge of the lead guide is caught at the paper surface, which may be torn.

The present invention arises in view of the above-mentioned problems, and aims at providing a pipe-slide type mechanical pencil in which the pipe end that functions as a lead guide is arranged to retreat gradually into a base according to abrasion of the lead when writing and an amount of projection of the writing lead projecting from the above-mentioned pipe end can be maintained within a certain range.

Means to Solve the Problems

A basic arrangement of a mechanical pencil in accordance with the present invention made in order to solve the above-mentioned problems is such that the mechanical pencil is arranged to grasp and release a writing lead by reciprocation of a chuck provided in a body cylinder so as to inch the above-mentioned writing lead forward and has a rotational drive mechanism for rotationally driving a rotor in one direction in conjunction with retreat operation by the writing pressure applied to the above-mentioned writing lead and forward movement by releasing the writing pressure, a pipe support member for supporting a lead guide formed in the shape of a pipe is accommodated in a front end portion of the above-mentioned body cylinder, and a retreat drive mechanism is provided for gradually retreating the pipe-shaped lead guide supported by the above-mentioned pipe support member into the above-mentioned body cylinder in conjunction with rotational drive operation of the above-mentioned rotor which constitutes the above-mentioned rotational drive mechanism.

In a preferred embodiment in the mechanical pencil with the above-mentioned arrangement, the above-mentioned retreat drive mechanism is provided with a rotation limiting means for limiting rotation of the above-mentioned pipe support member so as to move in an axial direction, a first screw formed on the above-mentioned rotor side, and a second screw threadedly engaged with the above-mentioned first screw and formed on the above-mentioned pipe support member side.

In this case, the above-mentioned first screw is constituted by an external screw formed at a front end portion of the above-mentioned rotor, and the above-mentioned second screw is constituted by an internal screw formed at an inner periphery of the above-mentioned pipe support member.

In addition, the above-mentioned rotation limiting means is constituted by a bar-shaped rib formed along the axial direction at an inner periphery of the above-mentioned body cylinder and a groove formed along the axial direction in the above-mentioned pipe support member, and the above-mentioned groove is engaged with the above-mentioned rib so that the above-mentioned pipe support member may move only in the axial direction.

Further, in the preferred embodiment as described above, it is desirable that forward movement of the above-mentioned chuck allows the above-mentioned pipe support member which is brought into abutment with a front end portion of the above-mentioned chuck to move forward by releasing the threaded engagement between the above-mentioned first screw and the second screw.

Further, in another preferred embodiment in the above-mentioned mechanical pencil, the above-mentioned retreat drive mechanism is provided with a rotation transmission means for transmitting the rotational drive operation of the above-mentioned rotor to the above-mentioned pipe support member, a first screw formed on the above-mentioned pipe support member side, and a second screw threadedly engaged with the above-mentioned first screw and formed on the above-mentioned body cylinder side.

In this case, the above-mentioned first screw is constituted by an external screw formed at an outer periphery of the above-mentioned pipe support member, and the above-mentioned second screw is constituted by an internal screw formed at an inner periphery of the above-mentioned body cylinder.

In addition, the above-mentioned rotation transmission means is constituted by the bar-shaped rib formed along the axial direction at the front end portion of the above-mentioned rotor and the groove formed along the axial direction in the above-mentioned pipe support member, and the above-mentioned rib is engaged with the above-mentioned groove so that the rotational drive operation of the above-mentioned rotor may be transmitted to the above-mentioned pipe support member.

Further, also in the above-mentioned preferred embodiment, it is desirable that forward movement of the above-mentioned chuck allows the above-mentioned pipe support member which is brought into abutment with the front end portion of the above-mentioned chuck to move forward by releasing the threaded engagement between the above-mentioned first screw and the second screw.

On the other hand, in a preferred embodiment in the rotational drive mechanism as described above, the above-mentioned rotational drive mechanism is provided with a spring clutch including a bi-directional rotation member which is rotationally driven bi-directionally in conjunction with retreat operation by the writing pressure applied to the above-mentioned writing lead and forward movement by releasing the writing pressure, and a coil spring which is wound around and covers the above-mentioned bi-directional rotation member and the above-mentioned rotor, comes into pressure contact with both (the above-mentioned bi-directional rotation member and the above-mentioned rotor) by means of rotation in one direction of the above-mentioned bi-directional rotation member to transmit the rotational operation in the above-mentioned one direction from the bi-directional rotation member to the rotor, and cancels the above-mentioned pressure contact with both of them by means of rotation in the other direction of the above-mentioned bi-directional rotation member so that the transmission of the rotational operation in the other direction from the bi-directional rotation member to the rotor is stopped.

In this case, it is desirable that the above-mentioned rotational drive mechanism is further provided with a second spring clutch including a second coil spring which is wound around and covers a non-rotating member and the above-mentioned rotor, allows rotational operation of the above-mentioned rotor as pressure contact with the above-mentioned non-rotating member and the above-mentioned rotor is released when the above-mentioned bi-directional rotation member is in rotational operation in the above-mentioned one direction, comes into pressure contact with both the above-mentioned non-rotating member and the above-mentioned rotor when the above-mentioned bi-directional rotation member is in rotational operation in the above-mentioned other direction, and stops the rotational operation of the above-mentioned rotor.

Further, in another preferred embodiment in the above-mentioned rotational drive mechanism, the rotor which constitutes the rotational drive mechanism is formed into the shape of a ring, first and second cam faces are respectively formed at one end face and another end face of the rotor in an axial direction, and first and second fixed cam faces are provided which are arranged on the above-mentioned body cylinder side so as to face the above-mentioned first and second cam faces, respectively, the above-mentioned first cam face in the ring-shaped rotor is brought into abutment with and meshed with the above-mentioned first fixed cam face by retreat operation of the above-mentioned chuck by way of the above-mentioned writing pressure, and the second cam face in the above-mentioned ring-shaped rotor is brought into abutment with and meshed with the above-mentioned second fixed cam face by releasing the above-mentioned writing pressure, and the second cam face on the above-mentioned rotor side and the above-mentioned second fixed cam face are arranged to have a half-phase shifted relationship with respect to one tooth of a cam in the axial direction in a situation where the first cam face on the above-mentioned rotor side is meshed with the above-mentioned first fixed cam face, and the first cam face on the above-mentioned rotor side and the above-mentioned first fixed cam face are arranged to have the half-phase shifted relationship with respect to one tooth of the cam in the axial direction in a situation where the second cam face on the above-mentioned rotor side is meshed with the above-mentioned second fixed cam face.

Effect of the Invention

According to the mechanical pencils with the above-described arrangements, since it is provided with the retreat drive mechanism for retreating the pipe support member into the body cylinder gradually by means of rotational drive force of the rotor in one direction which is obtained by writing operation, it operates so that a pipe-like lead guide may also retreat gradually as the writing lead is abraded according to the writing operation. Therefore, since a relative difference can be minimized between an amount of abrasion of the writing lead and an amount of retreat operation of the pipe-like lead guide while the writing proceeds, it is possible to considerably reduce occurrences of the lead breakage caused by excessive projection of the writing lead projecting from the lead guide and contact between the tip portion of the pipe-like lead guide and the paper surface.

Further, due to the forward movement of the chuck according to the knock operation, the pipe support member which is brought into abutment with the front end portion of the above-mentioned chuck releases the threaded engagement between the first screw and the second screw and is moved forward. Thus, it is possible to realize the projection operation of the pipe-like lead guide, simultaneously with the inching operation of the writing lead. At this time, by way of the above-mentioned operation, it is possible to prevent the writing lead from breaking or the lead guide from contacting the paper surface, even if the amount of projection of the lead by one knock operation is increased. Therefore, it is also possible to contribute to prevention of reduction in writing efficiency by performing frequent knock operations.

Furthermore, according to the mechanical pencil in accordance with the present invention, by means of the rotational action in one direction of the above-mentioned rotor, the writing lead can be rotationally driven in the same direction. Therefore, it is possible to prevent the writing lead from being locally abraded according to the progress of the writing and to solve the problem that the thickness of a drawn line and the boldness of the drawn line may change badly.

DESCRIPTION OF REFERENCE NUMERALS AND SIGNS

Figure 1:
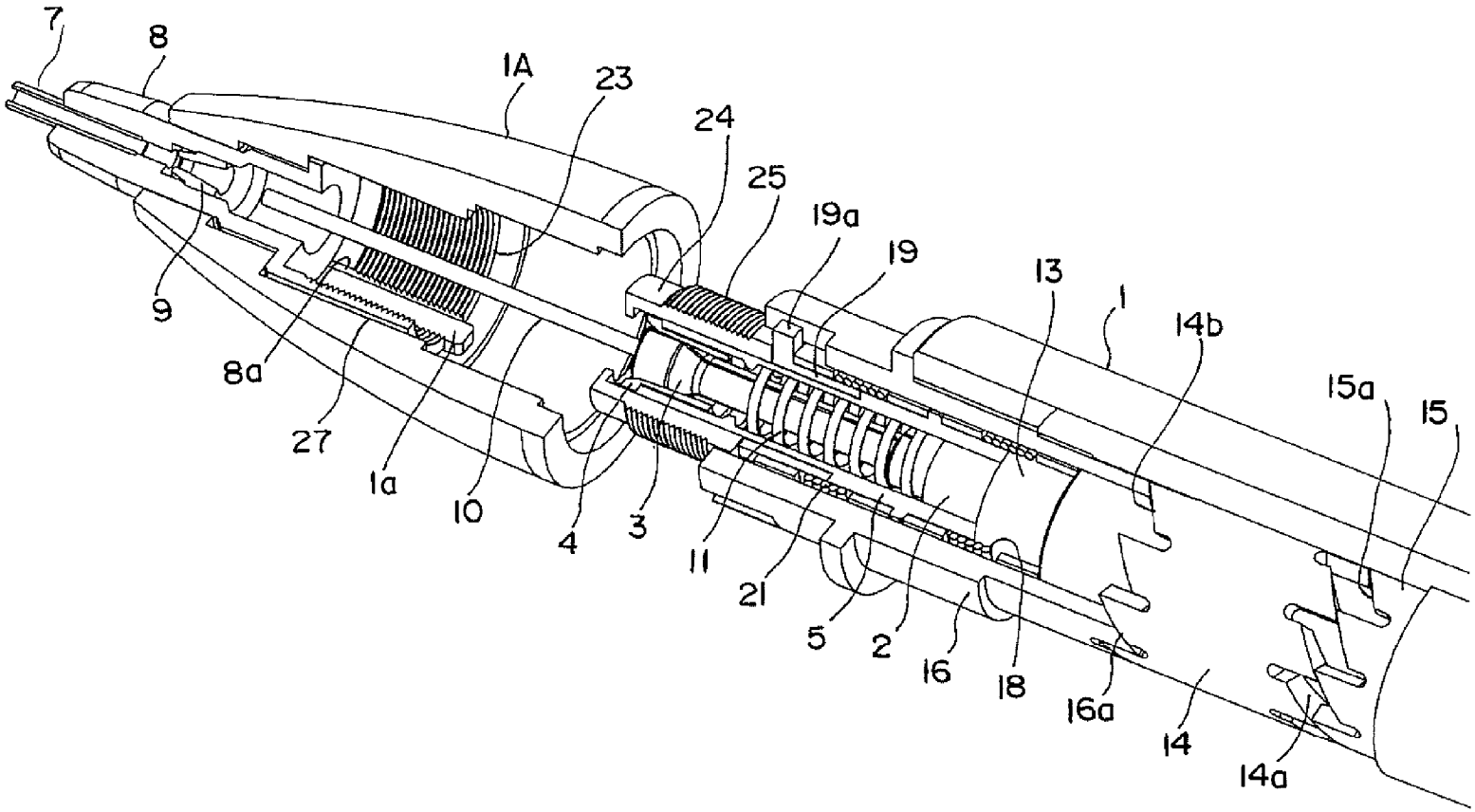
FIG. 1 is a perspective view showing a first half part, partially broken away, of a first preferred embodiment of a mechanical pencil in accordance with the present invention in which a base is separated from a body cylinder.
Figure 2:
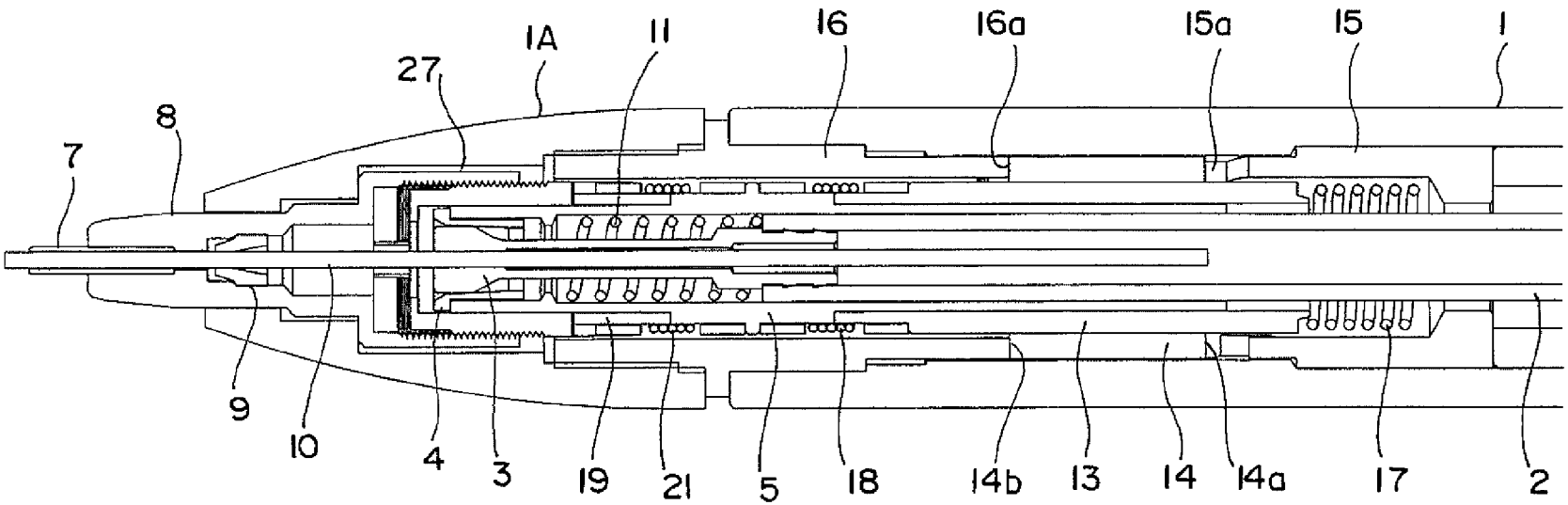
FIG. 2 is a sectional view showing the first half part similarly divided in an axial direction.
Figure 3:
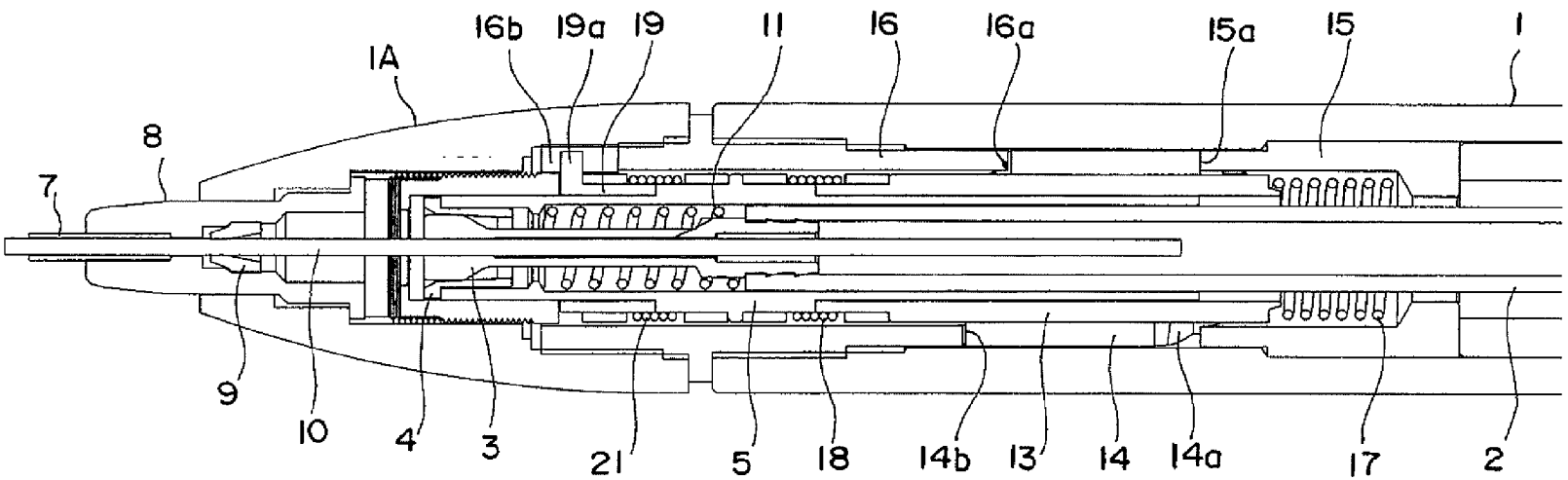
FIG. 3 is a sectional view showing the first half part divided along a plane which intersects perpendicularly to (at 90 degrees) one in the state as shown in FIG. 2.

1: body cylinder
1A: base
1*a*: rib
2: lead case
3: chuck
4: clamp
5: rotor
5*a*: rib
7: pipe end
8: pipe support member
8*a*: groove
8*b*: groove
10: writing lead
11: return spring
14: bi-directional rotation member
15: upper cam formation member
16: lower cam formation member
17: spring member
18: coil spring (first spring clutch)
19: non-rotating member
21: coil spring (second spring clutch)
23: second screw
24: screw formation member
25: first screw
31: first screw
32: second screw
36: rotor
37: upper cam formation member
38: lower cam formation member
40: torque canceller Best Mode for Carrying Out the Invention Hereinafter, a mechanical pencil in accordance with the present invention will be described with reference to the preferred embodiments shown in the drawings. FIGS. 1-3 illustrate a first preferred embodiment of the mechanical pencil in accordance with the present invention. FIG. 1 shows a first half part of the mechanical pencil and is a perspective view, partially broken away, in which a base is separated from a body cylinder. FIG. 2 is a sectional view showing the first half part divided in its axial direction. FIG. 3 is a sectional view showing the first half part divided along a plane which intersects perpendicularly to (at 90 degrees) one in the state as shown in FIG. 2.

In addition, structures of the respective parts in which like parts are given like reference signs will be described by means of reference signs. Each drawing to be explained below is illustrated where some reference numerals are suitably omitted depending on the drawing.

Reference numeral 1 denotes the body cylinder which constitutes the exterior. A cylindrical lead case 2 is coaxially accommodated in the above-mentioned body cylinder 1 at its axis portion. A chuck 3 is connected with a tip portion of this lead case 2. A tip portion of this chuck 3 is divided into a plurality of segments, and the divided tip segments are mounted so as to loosely fit in a clamp 4 which is formed in the shape of a ring. The above-mentioned ring-shaped clamp 4 is accommodated within a tip portion of a cylindrically shaped rotor 5 which is arranged so as to cover a periphery of the above-mentioned chuck 3.

In this preferred embodiment, a base 1A which constitutes a part of the body cylinder 1 is attached to a front end portion of the above-mentioned body cylinder 1, and a pipe end 7 which projects from this base 1A to function as a lead guide is provided. An end portion of the above-mentioned pipe end 7 is fitted within a tip portion of a pipe support member 8 located in the above-mentioned base 1A.

The above-mentioned pipe support member 8 is formed whose diameter increases towards its rear end portion side and whose cylindrical portion is integrally formed in the shape of a staircase. A holder chuck 9, made of rubber, in which a through hole is formed at its axis portion, is accommodated within the inner periphery on an attachment side of the pipe end 7. According to the above-mentioned structure, a linear lead inserting hole is so formed as to pass through the pipe end 7 from the lead case 2 via the chuck 3. A writing lead (refill lead) 10 is inserted into the lead inserting hole.

A return coil-spring 11 is arranged at a space between the above-mentioned rotor 5 and chuck 3. In addition, one end portion (rear end portion) of the above-mentioned return spring 11 is in abutment with a front end face of the above-mentioned lead case 2 and another end portion (front end portion) of the above-mentioned return spring 11 is accommodated in engagement with an engagement portion formed to project annularly in the rotor 5. Therefore, the chuck 3 in the rotor 5 is biased so that it retreats by action of the above-mentioned return spring 11 or so that the chuck 3 grasps the writing lead 10.

In the mechanical pencil shown in the drawings, when knock operation of a knock bar (not shown) which is disposed at a rear end portion of the body cylinder 1 is carried out, the above-mentioned lead case 2 advances in the body cylinder 1. The tip portion of the chuck 3 projects from a clamp 4 to cancel a grasp state of the writing lead 10. With cancellation of the above-mentioned knock operation, the lead case 2 and the chuck 3 retreat in the body cylinder 1 by the action of the return spring 11.

As described above, in a situation where the tip portion of a chuck 3 projects from the clamp 4, the above-mentioned writing lead 10 is temporarily held by an inner periphery of the holder chuck 9. In this situation, the chuck 3 retreats and its tip portion is accommodated within the above-mentioned clamp 4. Thus, the chuck 3 causes the writing lead 10 to be in the grasp state again. In other words, the writing lead is grasped and released when the chuck 3 moves back and forth by repeating the knock operation of the above-mentioned knock bar, so that the writing lead operates to inch forward from the chuck 3 stepwise.

As shown in FIGS. 2 and 3, an outer periphery of in the center of the above-mentioned rotor 5 is formed to have a somewhat large diameter. A second half part of the rotor 5 is rotatably accommodated in a cylindrical body 13 which constitutes a part of bi-directional rotation member to be set forth later, and the bi-directional rotation member 14 which is formed cylindrically is fitted onto an outer periphery substantially in the center of the cylindrical body 13.

As shown in FIG. 1, a first cam face 14*a* is formed at one end face (rear end face) of the above-mentioned bi-directional rotation member 14, and a second cam face 14*b* is formed at another end face (front end face) of the bi-directional rotation member 14. In addition, the above-mentioned first cam face 14*a* and second cam face 14*b* have formed sawtooth-shaped cams continuously along the annular end faces, respectively.

On the other hand, the upper cam formation member 15 formed cylindrically is attached in the body cylinder 1 on a rear end side of the above-mentioned bi-directional rotation member 14. A fixed cam face (also referred to as "first fixed cam face") 15*a* is formed at a front end portion of the above-mentioned upper cam formation member 15 so as to face the first cam face 14*a* in the above-mentioned bi-directional rotation member 14.

Further, a cylindrical lower cam formation member 16 is mounted on the body cylinder 1 side so as to face the second cam face 14*b* in the above-mentioned bi-directional rotation member 14, and a fixed cam face (also referred to as "second fixed cam face") 16*a* is formed at the rear end portion in the axial direction so as to face the second cam face 14*b* in the above-mentioned bi-directional rotation member 14.

As for the above-mentioned first fixed cam face 15*a* and the second fixed cam face 16*a*, the sawtooth-shaped cams are also formed continuously along the annular end faces, respectively. A pitch of the respectively arranged cams is the same as that of the respectively arranged cams of the first cam face 14*a* and the second cam face 14*b* formed in the above-mentioned bi-directional rotation member 14. In addition, a rotational action of the bi-directional rotation member 14 by means of the first and second cam faces 14*a* and 14*b* which are formed in the above-mentioned bi-directional rotation member 14 and the above-mentioned first fixed cam face 15*a* and second fixed cam face 16*a* will be described in detail later.

As shown in FIGS. 2 and 3, the rear end portion of the above-mentioned upper cam formation member 15 formed cylindrically is inwardly bent towards the above-mentioned lead case 2 which is arranged axially. A coil spring member 17 is provided in a space formed between an inner surface of the thus bent upper cam formation member 15 and the rear end portion of the cylindrical body 13 which constitutes a part of bi-directional rotation member. It is arranged that the above-mentioned spring member 17 acts to bias forward the above-mentioned cylindrical body 13, and the above-mentioned rotor 5 and the chuck 3 etc. are pushed by the above-mentioned cylindrical body 13 which is subjected to this bias force, so as to move forward.

On the other hand, as shown in FIGS. 2 and 3, the coil spring 18 is wound around and covers the outer periphery formed to have the somewhat lager diameter in the center of the above-mentioned rotor 5 and the outer periphery of the front end portion of the cylindrical body 13 having mounted the bi-directional rotation member 14 on its periphery. A spring clutch (hereinafter, also referred to as "first spring clutch" and indicated by the same reference numeral as that for the coil spring 18) is constituted by the above-mentioned cylindrical body 13, the rotor 5, and the above-mentioned coil spring 18.

Further, a cylindrical non-rotating member 19 is provided closer to the front side of the outer periphery which is formed to have the somewhat lager diameter in the center of the above-mentioned rotor 5. As shown in FIG. 3, a part of above-mentioned non-rotating member 19 is outwardly bent to be L-shaped in section so that its tip forms a narrow protrusion 19*a*. This protrusion 19*a* is inserted into a groove 16*b* formed along an axial direction of the above-mentioned lower cam formation member 16. Therefore, it is arranged that the non-rotating member 19 cannot rotate but can move in the axial direction.

Further, a second coil spring 21 is wound around and covers the outer periphery formed to have the somewhat lager diameter in the center of the rotor 5 and an outer periphery of the above-mentioned non-rotating member 19. A spring clutch (hereinafter, also referred to as "second spring clutch" and indicated by the same reference numeral as that for the second coil spring 21) is constituted by the above-mentioned rotor 5, the non-rotating member 19, and the above-mentioned second coil spring 21.

In addition, in the preferred embodiment as described above, a rotational drive mechanism in which the writing lead 10 is rotated is constituted by the chuck 3, the clamp 4, the rotor 5, the return spring 11, the cylindrical body 13, the non-rotating member 19, the coil spring 18 which constitutes the first spring clutch, the coil-spring 21 which constitutes the second spring clutch, etc.

On the other hand, as shown in FIG. 1, the pipe support member accommodated in the above-mentioned base 1A has formed an internal screw 23 at an inner periphery of a large diameter portion on the rear end side. In addition, in this preferred embodiment, the above-mentioned internal screw 23 is also referred to as a second screw. A groove (slot) 8*a* is formed along the axial direction at the above-mentioned large diameter portion of the pipe support member 8.

Further, it is arranged that a bar-shaped rib 1*a* is formed in the above-mentioned base 1A along its inner surface and the above-mentioned groove 8*a* is engaged with the above-mentioned rib 1*a* so that the above-mentioned pipe support member 8 may move only in the axial direction inside the base 1A. In other words, the bar-shaped rib 1*a* formed in the above-mentioned base 1A and groove 8*a* formed in the pipe support member 8 constitute a rotation limiting means for limiting the rotation of the pipe support member 8.

Furthermore, a screw formation member 24 formed cylindrically is mounted to a front end portion of the above-mentioned rotor 5, and an external screw 25 is formed on a periphery of this screw formation member 24. In addition, in this preferred embodiment, the above-mentioned external screw 25 is also referred to as a first screw. The above-mentioned first screw 25 and the second screw 23 are arranged to have the same pitch and formed so that internal and external diameters may be in agreement with each other.

Thus, the above-mentioned base 1A is mounted to the front end of the body cylinder 1 so that the first screw 25 is threadedly engaged with the second screw 23 as shown in FIGS. 2 and 3. In this case, in addition, the slot 8*a* is formed along the axial direction at the above-mentioned large diameter portion of the pipe support member 8, and, as already described, a predetermined gap 27 is formed between the outer periphery of the above-mentioned large diameter portion and the inner periphery of the above-mentioned base 1A as shown in FIGS. 1 and 2. Accordingly, the base 1A is mounted to the front end of the body cylinder so that the first screw 25 is threadedly engaged with the second screw 23 as one screw portion mates the other screw portion.

According to the first preferred embodiment of the mechanical pencil in accordance with the present invention as described above, in a situation where the chuck 3 grasps the writing lead 10, the above-mentioned rotor 5 together with the chuck 3 is accommodated about the axis in the above-mentioned body cylinder 1 so as to rotate. Except when the mechanical pencil is in the writing state, the rotor 6 is biased forward through the above-mentioned cylindrical body 13 by action of the above-mentioned spring member 17.

Now, when the mechanical pencil is used i.e. in the case where the writing pressure is applied to the writing lead 10 projecting from the pipe end 7, the above-mentioned chuck 3 retreats against the bias force of the spring member 17, accordingly the rotor 6 and the cylindrical body 13 as well as the bi-directional rotation member 14 retreat in the axial direction. Therefore, the first cam face 14*a* formed at the bi-directional rotation member 14 as shown in FIG. 1 moves towards the first fixed cam face 15*a* formed at the upper cam formation member 15. Thus, the above-mentioned bi-directional rotation member 14 is subjected to the rotational action in one direction i.e., the counter-clockwise rotational action in this preferred embodiment, and the above-mentioned cylindrical body 13 is also subjected to the rotational action in the same direction.

As described above, when the cylindrical body 13 is subjected to the counter-clockwise rotational operation, the coil spring 18 which constitutes the first spring clutch wound between the above-mentioned cylindrical body 13 and the rotor 5 is coiled around the above-mentioned cylindrical body 13 so as to decrease in diameter. Therefore, the coil spring 18 comes into pressure contact with the cylindrical body 13 and the rotor 5, to transmit the counter-clockwise rotational operation of the above-mentioned cylindrical body 13 to the rotor 5. Thus, counter-clockwise rotational movement of the rotor 5 is transmitted to the writing lead 10 through the chuck 3.

At this time, the second spring clutch constituted by the second coil spring 21 wound between the above-mentioned rotor 5 and the non-rotating member 19 is subjected to the counter-clockwise rotational operation of the rotor 5 and the coil spring 18 is rewound and increases in diameter. Therefore, the pressure contact between the rotor 5 and the non-rotating member 19 is released (a slide occurs) and acts to allow the above-mentioned rotor 5 to rotate counter-clockwise.

On the other hand, when the writing pressure is released, the cylindrical body 13, the bi-directional rotation member 14, and the rotor 6 are moved forward in the axial direction by action of the spring member 17 as shown in FIGS. 2 and 3. Therefore, as shown in FIG. 1, the second cam face 14*b* formed at the bi-directional rotation member 14 moves towards the second fixed cam face 16*a* formed in the lower cam formation member 16. Thus, in this preferred embodiment, the above-mentioned bi-directional rotation member 14 is subjected to the rotational action in the other direction (i.e., clockwise), and the above-mentioned cylindrical body 13 is also subjected to the rotational action in the same direction.

As described above, when the cylindrical body 13 is subjected to the clockwise rotational action, the coil spring 18 which constitutes the first spring clutch is rewound and increases in diameter. Therefore a slide is generated between the cylindrical body 13 and the rotor 5, and the clutch is released. At this time, the above-mentioned rotor 5 is dragged by the clockwise rotation of the cylindrical body 13 and is also going to rotate in the same direction. In this case, however, the second spring clutch constituted by the second coil spring 21 wound between the above-mentioned rotor 5 and the non-rotating member 19 comes into pressure contact with the non-rotating member 19 and the rotor 5, so that the above-mentioned rotor 5 is inhibited from rotating clockwise.

In addition, in the above-mentioned preferred embodiment, by providing the first spring clutch including at least the first coil spring 18, the rotational operation of the above-mentioned bi-directional rotation member 14 can be carried out to rotate in one direction while the writing proceeds. In addition to this, by providing the second spring clutch including the second coil spring 21, the writing lead can certainly perform the rotational operation in one direction and it is possible to improve reliability of operation. Thus, it is possible to prevent local abrasion of the writing lead according to the progress of the writing and to solve the problem that the thickness of a drawn line and the boldness of the drawn line may change badly.

On the other hand, when subjected to rotational drive operation of the above-mentioned rotor 5 according to the writing operation, the screw formation member 24 mounted to the front end of the rotor 5 is also subjected to rotational drive. The first screw 25 formed at the above-mentioned screw formation member 24 is threadedly engaged with the second screw 23 formed at the above-mentioned pipe support member 8, and it is arranged that the above-mentioned rotation limiting means allows the pipe support member 8 to move only in the axial direction.

Therefore, being subjected to the rotational drive operation of the rotor 5, the above-mentioned pipe support member 8 operates so that the pipe end 7 supported by the above-mentioned pipe support member may be retreated towards the body cylinder gradually. In other words, a retreat drive mechanism for retreating the pipe end 8 towards the body cylinder gradually is constituted by the rotation limiting means including the above-mentioned rib 1*a* and groove 8*a*, the first screw 25, the second screw 23, etc.

Figure 4:
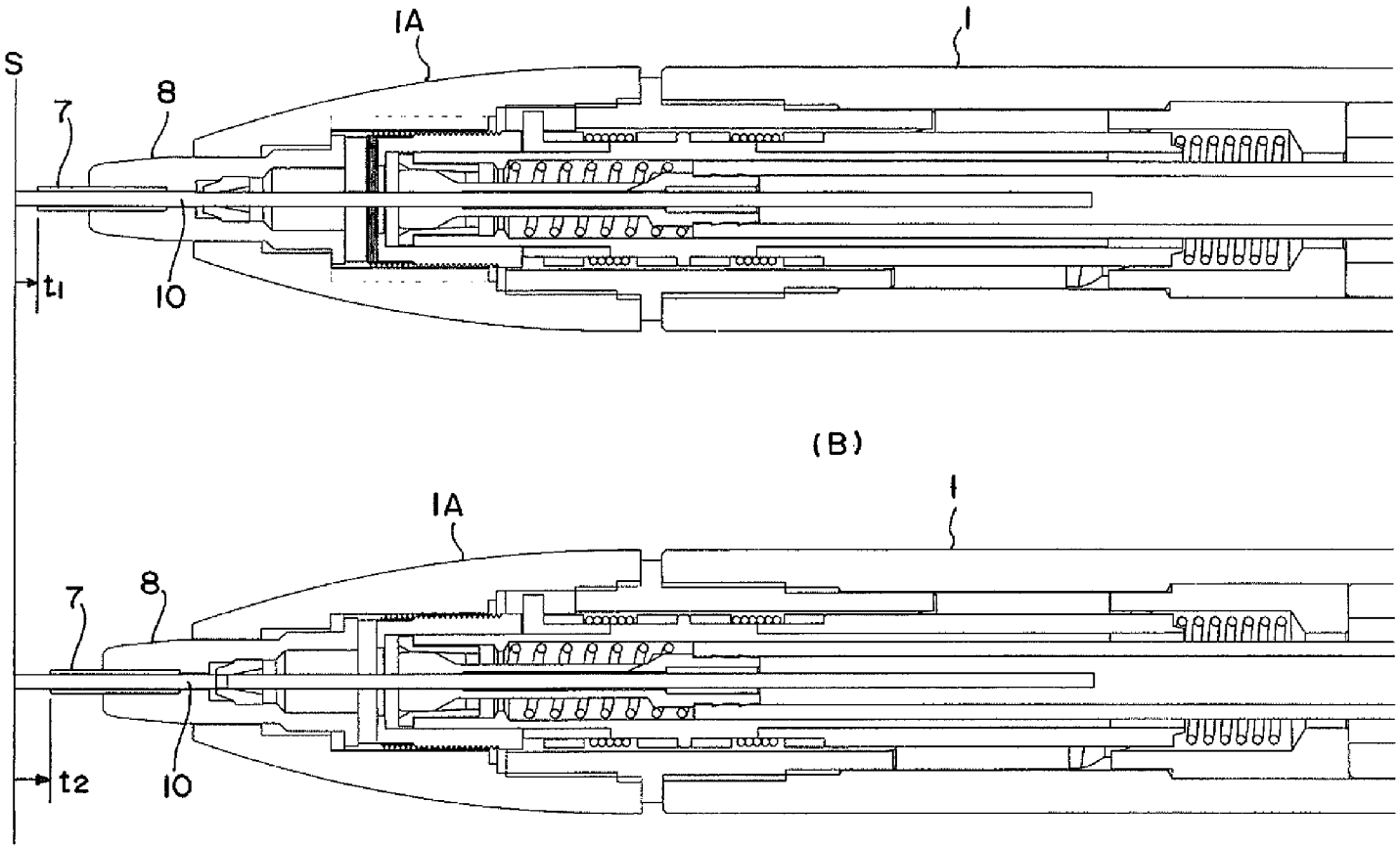
FIG. 4 is a sectional view for explaining operation of retreating a pipe end gradually while the writing proceeds.
Figure 5:
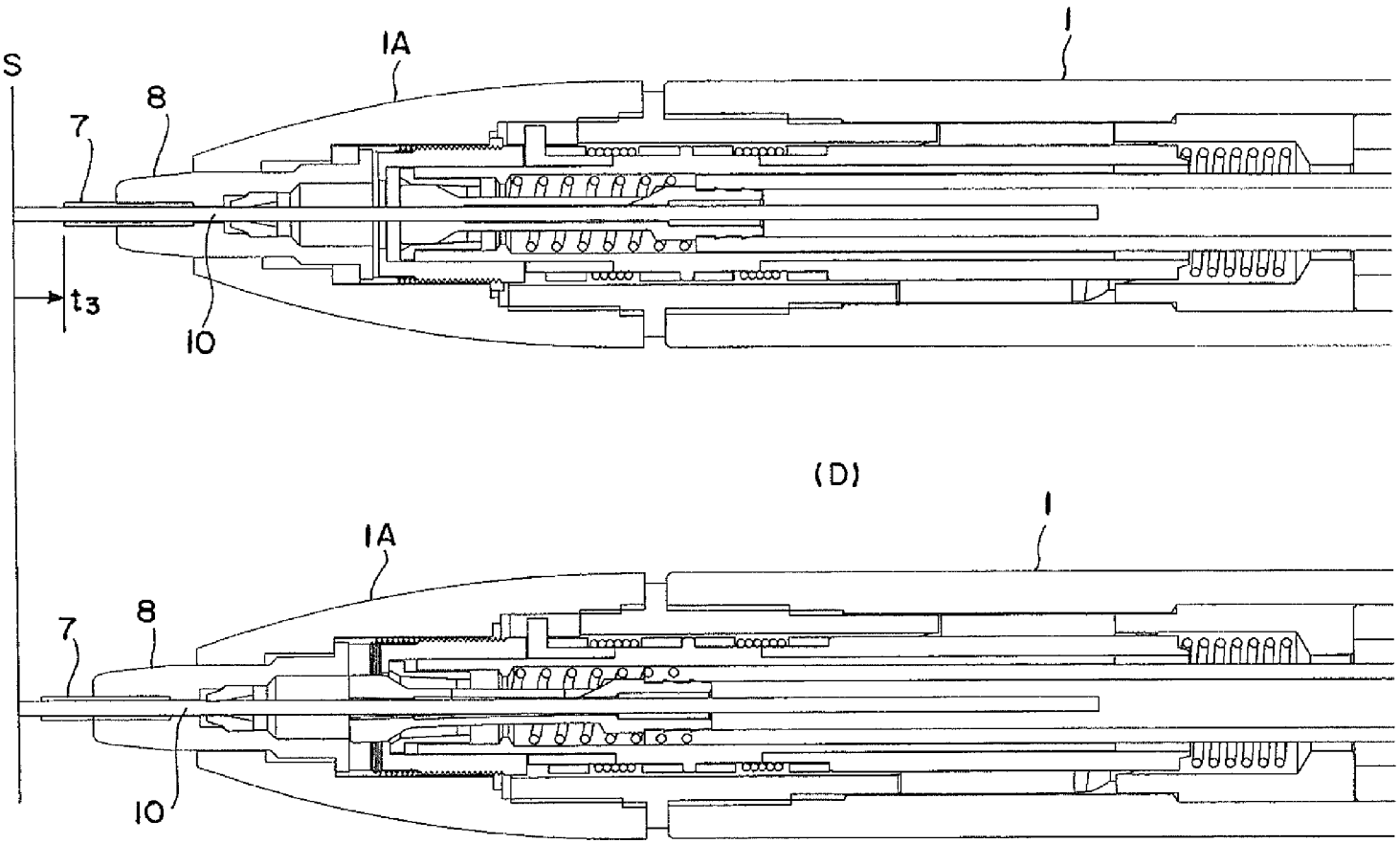
FIG. 5 is a sectional view for explaining the operation, following FIG. 4.

FIGS. 4 and 5 are for explaining the operation of the above-mentioned retreat drive mechanism which retreats the pipe end 7 gradually while the writing proceeds. In other words, FIG. 4(A) shows a situation where the pipe support member 8 has moved forward farthest. It is assumed that an end position of the writing lead 10 in this situation is indicated by S, and the writing lead 10 is shown for comparison in FIGS. 4 and 5 remaining in the end position S without abrasion.

In an initial situation as shown in FIG. 4(A), the pipe end 7 is located a distance t1 away from the end position S where the writing lead is. The above-mentioned retreat drive mechanism is operated by the rotational operation of the above-mentioned rotor while the writing proceeds, and the pipe end 7 is located a distance t2 away from the initial end position S of the writing lead as shown in FIG. 4(B). In fact, during this period, the writing lead is abraded according the writing so that its tip portion comes closer to the above-mentioned t2 side. Ideally, an amount of projection of the writing lead projecting from the pipe end 7 is constant.

Further, the above-mentioned retreat drive mechanism is operated by the rotational operation of the above-mentioned rotor while the writing proceeds, so that the pipe end 7 is located a distance t3 away from the initial end position S of the writing lead as shown in FIG. 5(C). Also in this case, in fact, the tip portion similarly moves closer to the above-mentioned t3 side due to the writing abrasion of the writing lead, and it is arranged that the amount of projection of the writing lead projecting from the pipe end 7 is ideally constant.

The situation as shown in FIG. 5(C) illustrates a situation where the pipe end 7 has retreated farthest. Now, by carrying out the knock operation of the knock bar (not shown) arranged at the rear end portion of the body cylinder 1, the chuck 3 moves forward and it is possible to inch forward the writing lead 10 by a predetermined amount by way of the already described action. Simultaneously with this, as shown in FIG. 5(D), the front end portion of the chuck 3 comes into abutment with a part of the above-mentioned pipe support member 8 so as to push it forward.

At this time, the threaded engagement between the first screw 25 of the screw formation member 24 mounted to the front end portion of the above-mentioned rotor 5 and the second screw 2 formed at the pipe support member 8 is released so that the pipe support member 8 moves forwards, resulting in the situation as shown in FIG. 4(A) again. Thus, it is possible to continue the writing operation.

According to the first preferred embodiment as described above, since the retreat drive mechanism for retreating the pipe end 8 towards the body cylinder gradually in conjunction with the writing operation is provided, a relative difference between an amount of abrasion of the lead and an amount of retreat operation of the pipe end while the writing proceeds can always be kept small, and it is possible to provide the mechanical pencil which brings about the original operational effects as described in the column of Effect of the Invention.

Figure 6:
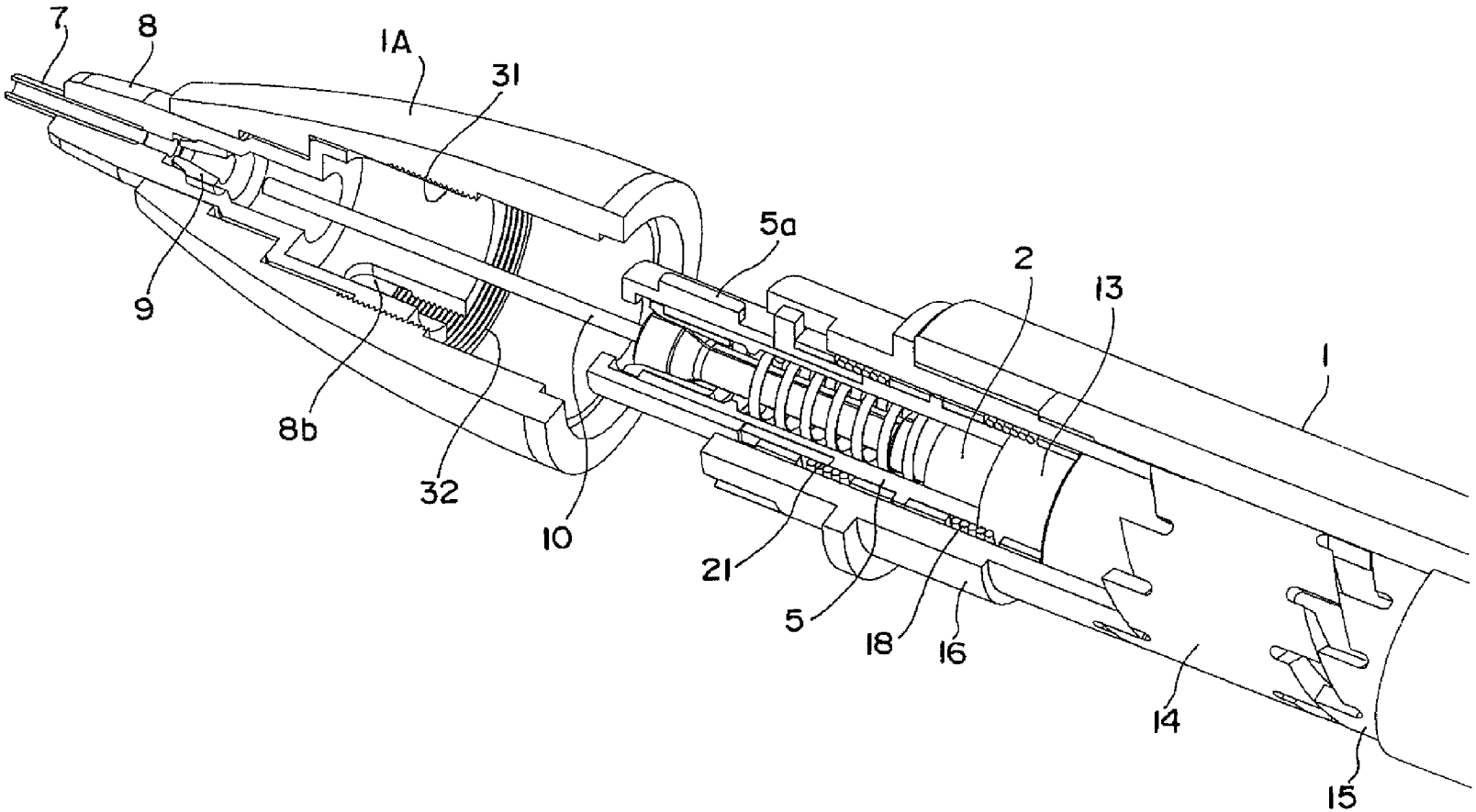
FIG. 6 is a perspective view showing the first half part, partially broken away, of a second preferred embodiment of the mechanical pencil in accordance with the present invention in which the base is separated from the body cylinder.
Figure 7:
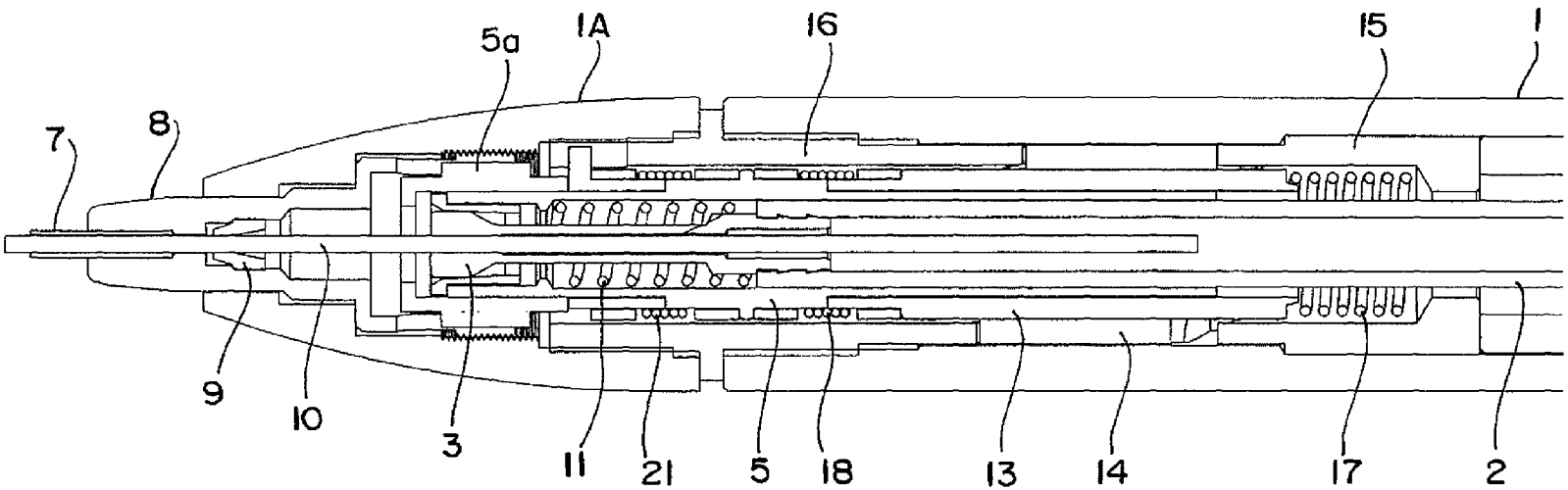
FIG. 7 is a sectional view showing the first half part similarly divided in the axial direction.

Next, FIGS. 6 and 7 show a second preferred embodiment in the mechanical pencil in accordance with the present invention. FIG. 6 is a perspective view in which the base is separated from the body cylinder in the first half part of the mechanical pencil, which is partially broken away. FIG. 7 is a sectional view showing the first half part in a situation where the base is mounted to the body cylinder and divided in the axial direction.

In addition, in the second preferred embodiment as shown in FIGS. 6 and 7, a structure of the rotational drive mechanism in which the rotor 5 is rotationally driven in conjunction with the writing operation is the same as that in the first preferred embodiment. A retreat drive mechanism for retreating the pipe-like lead guide (pipe end) 7 towards the body cylinder gradually is different in this preferred embodiment.

In other words, in this second preferred embodiment, within the pipe support member 8 accommodated in the base 1A, a groove (slot) 8*b* is formed at the large diameter portion on the rear end side along the axial direction. Further, a bar-shaped rib 5*a* is formed at the front end portion of the above-mentioned rotor 5 along the axial direction. In other words, the above-mentioned rib 5*a* on the rotor 5 side is engaged with the above-mentioned groove 8*b* on the pipe support member 8 side, to thereby constitute a rotation transmission means for transmitting the rotational drive operation of the above-mentioned rotor 5 to the pipe support member 8 side.

In addition, as shown in FIG. 6, an external screw 31 is formed on the outer periphery of the large diameter portion in the above-mentioned pipe support member 8, and the above-mentioned external screw 31 is referred to as the first screw in this preferred embodiment. Further, an internal screw 32 is formed at the inner periphery of the above-mentioned base 1A, and the above-mentioned internal screw 32 is referred to as the second screw in this preferred embodiment. Furthermore, the pipe support member 8 is accommodated within the base 1A in a situation where the above-mentioned first screw 31 and the second screw 32 are arranged to have the same pitch and threadedly engaged with each other.

Rotational drive force from the above-mentioned rotor 5 while the writing proceeds is transmitted to the pipe support member 8 side through the above-mentioned rotation transmission means which is constituted by the bar-shaped rib 5*a* and the groove 8*b*. Therefore, the pipe support member 8 is subjected to the rotational drive force from the rotor 5 and operates to retreat towards the body cylinder gradually by the action of the first screw 31 and the second screw 32. Similarly, the pipe end 8 operates to retreat gradually toward the body cylinder.

Therefore, also in the second preferred embodiment as shown in FIGS. 6 and 7, it is possible to obtain the same operational effect as that in the first preferred embodiment as previously described.

Figure 8:
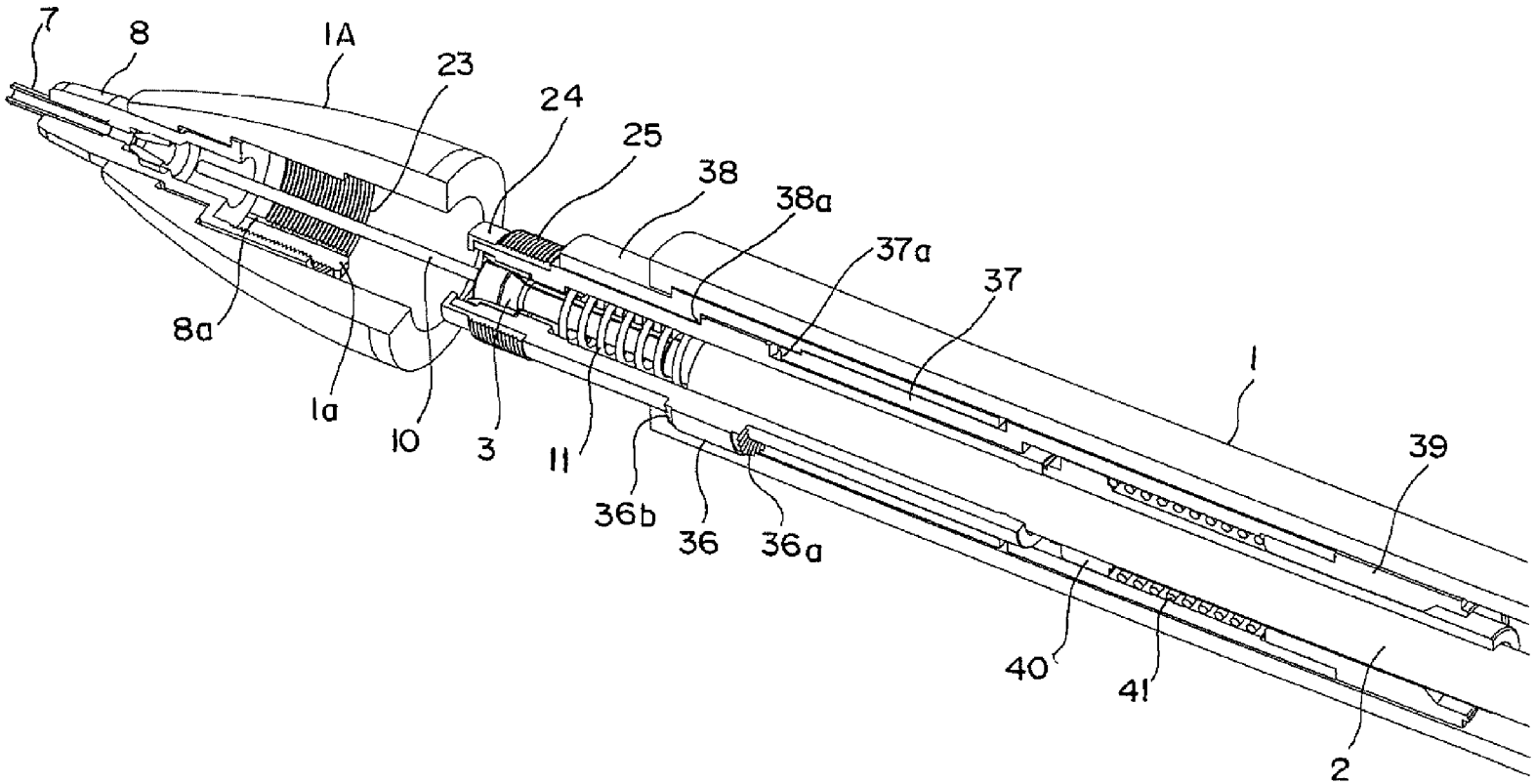
FIG. 8 is a perspective view showing the first half part, partially broken away, of a third preferred embodiment of the mechanical pencil in accordance with the present invention in which the base is separated from the body cylinder.
Figure 9:
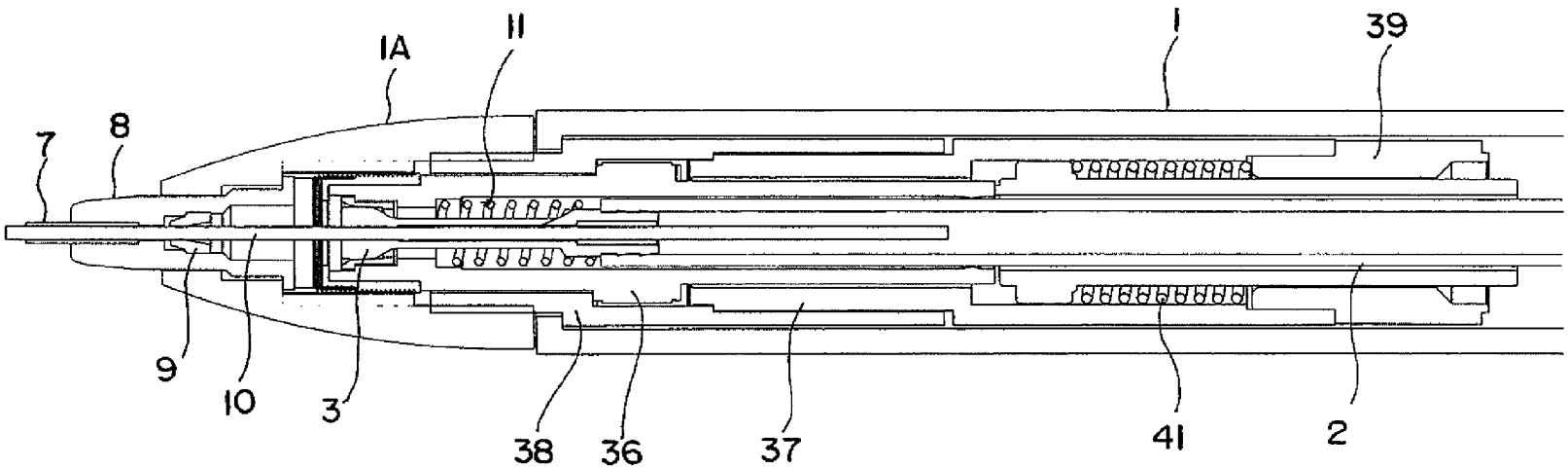
FIG. 9 is a sectional view showing the first half part similarly divided in the axial direction.

Next, FIGS. 8 and 9 show a third preferred embodiment in the mechanical pencil in accordance with the present invention. FIG. 8 is a perspective view in which the base is separated from the body cylinder in the first half part of the mechanical pencil, which is partially broken away. FIG. 9 is a sectional view showing the first half part in a situation where the base is mounted to the body cylinder and divided in the axial direction.

In addition, in the third preferred embodiment as shown in FIGS. 8 and 9, a structure of the retreat drive mechanism for retreating the pipe-like lead guide (pipe end) 7 towards the body cylinder gradually is the same as that in the first preferred embodiment shown in FIGS. 1 to 3. A rotational drive mechanism in which the rotor is rotationally driven in one direction in conjunction with the writing operation is different in this preferred embodiment. Further, in FIGS. 8 and 9, parts which achieve the same function as the respective parts as already described are identified by the same reference numerals, and therefore the description thereof will not be repeated.

Reference numeral 36 as shown in FIGS. 8 and 9 indicates the rotor whose central part in the axial direction is increased in diameter to be formed into the shape of a ring. A first cam face 36*a* is formed at one end face (rear end face) which is ring-shaped, and a second cam face 36*b* is formed at the other end face (front end face) which is ring-shaped. On the other hand, at the rear end portion of the above-mentioned rotor 36, a cylindrical upper cam formation member 37 is mounted in the body cylinder 1 so as to cover the rear end portion of the rotor 36. At the front end portion of the above-mentioned upper cam formation member 37, a fixed cam face (also referred to as "first fixed cam face") 37*a* is formed so as to face the first cam face 36*a* in the above-mentioned rotor 36.

Furthermore, a cylindrical lower cam formation member 38 is mounted on the body cylinder 1 side so as to face the second cam face 36*b* in the above-mentioned rotor 36, and a fixed cam face (also referred to as "second fixed cam face") 38*a* is formed at a step portion which is formed by expanding the inner diameter at the central part. In addition, a relationship and mutual operation among the first and second cam faces 36*a* and 36*b* which are formed at the above-mentioned rotor 36, the above-mentioned first fixed cam face 37*a*, and the second fixed cam face 38*a* will be described in detail later with reference to FIGS. 10 and 11.

A cylindrical stopper 39 is fitted to the rear end portion inside the upper cam formation member 37 which is formed cylindrically, and a coil-spring member 41 is provided between a front end portion of the stopper 39 and a torque canceller 40 which is formed cylindrically and can move in the axial direction.

It is arranged that the above-mentioned spring member 41 acts so as to bias forward the above-mentioned torque canceller 40 and the above-mentioned rotor 36 is pushed to move forward by the above-mentioned torque canceller 40 subjected to this bias force.

According to the above-mentioned structure, in a situation where the chuck 3 grasps the writing lead, the above-mentioned rotor 36 together with the chuck 3 is accommodated in the above-mentioned body cylinder 1 so as to be rotatable about the axis. Further, except when the mechanical pencil is in the writing state, the rotor 36 is biased forward by the action of the above-mentioned spring member 41 through the above-mentioned torque canceller 40.

On the other hand, when the mechanical pencil is used, i.e., when the writing pressure is applied to the writing lead 10 protruding from the pipe end 7, the above-mentioned chuck 3 retreats against the bias force of the spring member 41.

According to this operation, the rotor 36 also retreats in the axial direction. Therefore, the first cam face 36*a* formed at the rotor 36 engages with and meshes with the above-mentioned first fixed cam face 37*a*.

FIGS. 10(A) to 10(C) and FIGS. 11(D) and 11(E) are for explaining in order the fundamental operation of the rotational drive mechanism which rotationally drives the rotor 36 by the above-mentioned operation. In FIGS. 10 and 11, reference numeral 36 indicates the above-mentioned rotor which is schematically shown, and at one end face thereof (upper face in figures) the first cam face 36*a* having a continuous sawtooth shape along a circumferential direction is formed into the shape of a ring. Further, similarly, the second cam face 36*b* having a continuous sawtooth shape along the circumferential direction is formed into the shape of a ring at another end face (lower face in figures) of the rotor 36.

Figure 10:
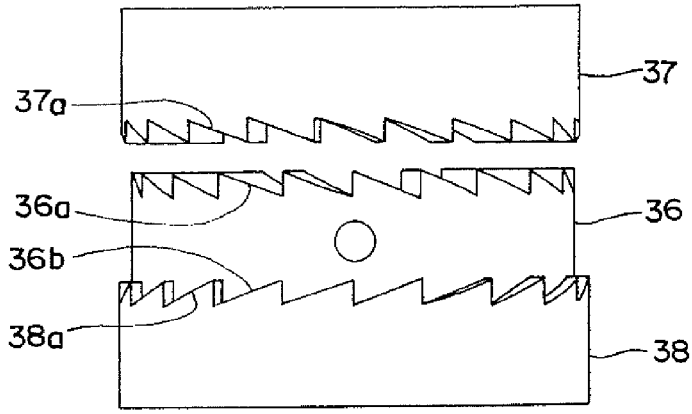
FIG. 10 is a schematic view for explaining, in order, rotational drive operations of a rotor employed in embodiments as shown in FIGS. 8 and 9.
Figure 10:
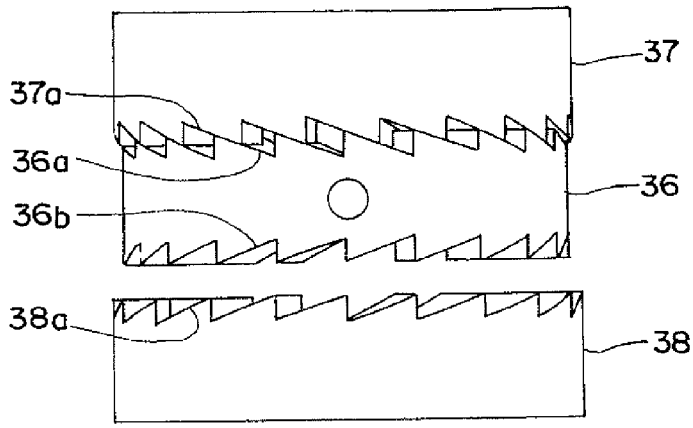
Figure 10:
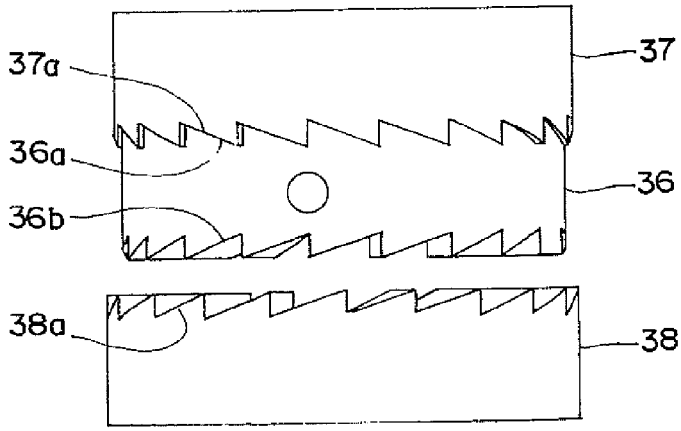
Figure 11:
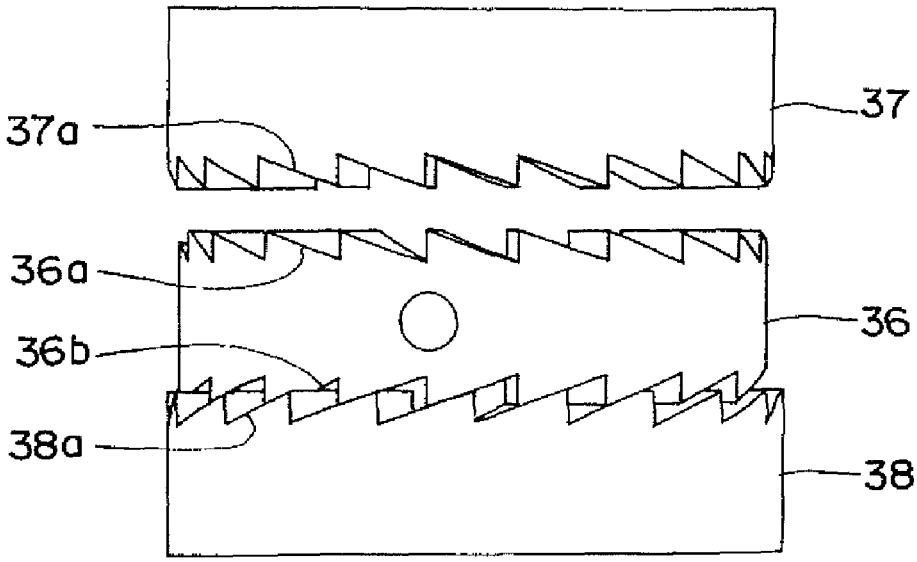
FIG. 11 is a schematic view for explaining the rotational drive operations of the rotor, following FIG. 10.
Figure 11:
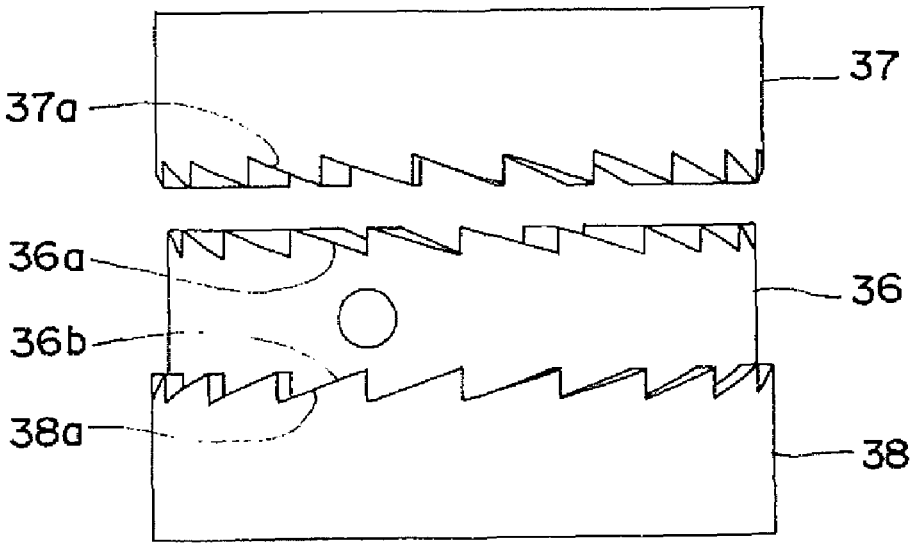

On the other hand, as shown in FIGS. 10 and 11, the first fixed cam face 37*a* having a continuous sawtooth shape along the circumferential direction is also formed at a ring-shaped end face of the upper cam formation member 37, and the second fixed cam face 38*a* having a continuous sawtooth shape along the circumferential direction is also formed at a ring-shaped end face of the lower cam formation member 38. The first cam face 36*a* and the second cam face 36*b* formed at the rotor, the first fixed cam face 37*a* formed at the upper cam formation member 37, and the second fixed cam face 38*a* formed at the lower cam formation member 38 are each arranged to have substantially the same pitch.

FIG. 10(A) shows a relationship among the upper cam formation member 37, the rotor 36, and the lower cam formation member 38 except when the mechanical pencil is in the writing state. In this situation, by the bias force of the above-mentioned spring member 41, the second cam face 36*b* formed in the rotor 36 is brought into abutment with the second fixed cam face 38*a* side of the lower cam formation member 38 mounted at the body cylinder 1. At this time, the first cam face 36*a* on the above-mentioned rotor 36 side and the above-mentioned first fixed cam face 37*a* are arranged to have a half-phase (half-pitch) shifted relationship with respect to one tooth of the cam in the axial direction.

FIG. 10(B) shows an initial situation where the writing pressure is applied to the writing lead 10 by use of the mechanical pencil. In this case, as described above, the rotor 36 compresses the above-mentioned spring member 41 and retreats in the axial direction while the chuck 3 retreats. Thus, the rotor 36 moves towards the upper cam formation member 37 mounted at the body cylinder 1.

FIG. 10(C) shows a situation where the writing pressure is applied to the writing lead 10 by use of the mechanical pencil and the rotor 36 comes into abutment with the upper cam formation member 37 side and retreats. In this case, the first cam face 36*a* formed at the rotor 36 meshes with the first fixed cam face 37*a* on the upper cam formation member 37 side. Thus, the rotor is subjected to rotational drive corresponding to the half-phase (half-pitch) with respect to one tooth of the first cam face 36*a*.

In addition, circle (O) drawn in the center of the rotor 36 in FIGS. 10 and 11 indicates an amount of rotational movement of the rotor 36. Further, in the situation shown in FIG. 10(C), the second cam face 36*b* on the above-mentioned rotor 36 side and the above-mentioned second fixed cam face 38*a* are arranged to have a half-phase (half-pitch) shifted relationship with respect to one tooth of the cam in the axial direction.

Next, FIG. 11(D) shows an initial situation where drawing with the mechanical pencil is finished and the writing pressure to the writing lead is released. In this case, the rotor 36 moves forward in the axial direction by action of the above-mentioned spring member 41. Thus, the rotor 36 moves towards the lower cam formation member 38 mounted at the body cylinder 1.

Furthermore, FIG. 11(E) shows a situation where the rotor 36 comes into abutment with the lower cam formation member 38 side and moves forward by action of the above-mentioned spring member 41. In this case, the second cam face 36*b* formed at the rotor 36 meshes with the second fixed cam face 38*a* on the lower cam formation member 38 side. Thus, the rotor 36 is subjected again to the rotational drive corresponding to the half-phase (half-pitch) of one tooth of the second cam face 36*b*.

Therefore, as shown by circle (O) drawn in the center of the rotor 36, according to reciprocating movement of the rotor (which is subjected to the writing pressure) in the axial direction, the rotor 36 is subjected to the rotational drive corresponding to one tooth (one pitch) of the first and second cam faces 36*a* and 36*b*, and the writing lead 10 grasped by the chuck 3 is rotationally driven through the chuck 3 similarly.

The screw formation member 24 formed cylindrically is mounted to the front end portion of the above-mentioned rotor 36, and the above-mentioned first screw 25 is formed at the outer periphery of this screw formation member 24. Further, the structure in which the pipe support member 8 is provided with the second screw 23 to be threadedly engaged with the first screw 25 is the same as that of the first preferred embodiment as described above with reference to FIGS. 1-3. Therefore, also in the third preferred embodiment shown in FIGS. 8 and 9, it is possible to obtain the same operational effect as in first preferred embodiment as previously described.

In addition, the cylindrical torque canceller 40 to which the bias force of the above-mentioned coil spring member 41 is applied to push the rotor 36 forward generates a slide between the front end face of this torque canceller 40 and the rear end face of the above-mentioned rotor 36, and acts so that the rotational movement of the above-mentioned rotor 36 is prevented from being transmitted to the spring member 41.

In other words, since the torque canceller 40 formed cylindrically is interposed between the above-mentioned rotor and the spring member 41, the rotational motion of the above-mentioned rotor is prevented from being transmitted to the above-mentioned spring member, and it is possible to solve the problem that back torsion (spring torque) of the spring member 41 occurs and places an obstacle to rotation operation of the rotor 36.

The invention claimed is:

1. A mechanical pencil arranged to grasp and release a writing lead by reciprocation of a chuck provided in a body cylinder so as to inch said writing lead forward and having a rotational drive mechanism for rotationally driving a rotor in one direction in conjunction with retreat operation by writing pressure applied to said writing lead and forward movement of said writing lead by releasing the writing pressure, characterized in that a pipe support member for supporting a lead guide formed in the shape of a pipe is accommodated in a front end portion of said body cylinder, and a retreat drive mechanism is provided for gradually retreating said pipe support member into said body cylinder, said retreat operation caused by rotational drive operation of said rotor which constitutes said rotational drive mechanism when the writing pressure is applied to said writing lead after said reciprocation of said chuck.

2. The mechanical pencil as claimed in claim 1, characterized in that said retreat drive mechanism is provided with a rotation limiting member limiting rotation of said pipe support member so as to move in an axial direction, a first screw formed on said rotor side, and a second screw threadedly engaged with said first screw and formed on said pipe support member side.

3. The mechanical pencil as claimed in claim 2, characterized in that said first screw is an external screw formed at a front end portion of said rotor, and said second screw is an internal screw formed at an inner periphery of said pipe support member.

4. The mechanical pencil as claimed in claim 2, characterized in that said rotation limiting member is constituted by a bar-shaped rib formed along the axial direction at an inner periphery of said body cylinder and a groove formed along the axial direction in said pipe support member, and said groove is engaged with said rib so that said pipe support member may move only in the axial direction.

5. The mechanical pencil as claimed in claim 2, characterized in that forward movement of said chuck allows said pipe support member which is brought into abutment with a front end portion of said chuck to move forward by releasing the threaded engagement between said first screw and the second screw.

6. The mechanical pencil as claimed in claim 1, characterized in that said retreat drive mechanism is provided with a rotation transmission member transmitting the rotational drive operation of said rotor to said pipe support member, a first screw formed on said pipe support member side, and a second screw threadedly engaged with said first screw and formed on said body cylinder side.

7. The mechanical pencil as claimed in claim 6, characterized in that said first screw is an external screw formed at an outer periphery of said pipe support member, and said second screw is an internal screw formed at an inner periphery of said body cylinder.

8. The mechanical pencil as claimed in claim 6, characterized in that said rotation transmission member is constituted by a bar-shaped rib formed along the axial direction at a front end portion of said rotor and a groove formed along the axial direction in said pipe support member, and said rib is engaged with said groove so that the rotational drive operation of said rotor may be transmitted to said pipe support member.

9. The mechanical pencil as claimed in claim 6, characterized in that forward movement of said chuck allows said pipe support member which is brought into abutment with a front end portion of said chuck to move forward by releasing the threaded engagement between said first screw and the second screw.

10. The mechanical pencil as claimed in any one of claims 1 to 9, characterized in that said rotational drive mechanism is provided with a spring clutch including a bi-directional rotation member which is rotationally driven bi-directionally in conjunction with retreat operation by the writing pressure applied to said writing lead and forward movement by releasing the writing pressure, and a coil spring which is wound around and covers said bi-directional rotation member and said rotor, comes into pressure contact with both (said bi-directional rotation member and said rotor) by means of rotation in one direction of said bi-directional rotation member to transmit the rotational operation in said one direction from the bi-directional rotation member to the rotor, and cancels said pressure contact with both of them by means of rotation in the other direction of said bi-directional rotation member so that the transmission of the rotational operation in the other direction from the bi-directional rotation member to the rotor is stopped.

11. The mechanical pencil as claimed in claim 10, characterized in that said rotational drive mechanism is further provided with a second spring clutch including a second coil spring which is wound around and covers a non-rotating member and said rotor, allows rotational operation of said rotor as pressure contact with said non-rotating member and said rotor is released when said bi-directional rotation member is in rotational operation in said one direction, comes into pressure contact with both said non-rotating member and said rotor when said bi-directional rotation member is in rotational operation in said other direction, and stops the rotational operation of said rotor.

12. The mechanical pencil as claimed in any one of claims 1 to 9, characterized in that said rotor which constitutes said rotational drive mechanism is formed into the shape of a ring, first and second cam faces are respectively formed at one end face and another end face of the rotor in an axial direction, and first and second fixed cam faces are provided which are arranged on said body cylinder side so as to face said first and second cam faces, respectively, said first cam face in said ring-shaped rotor is brought into abutment with and meshed with said first fixed cam face by retreat operation of said chuck byway of said writing pressure, the second cam face in said ring-shaped rotor is brought into abutment with and meshed with said second fixed cam face by releasing said writing pressure, and the second cam face on said rotor side and said second fixed cam face are arranged to have a half-phase shifted relationship with respect to one tooth of a cam in the axial direction in a situation where the first cam face on said rotor side is meshed with said first fixed cam face, and the first cam face on said rotor side and said first fixed cam face are arranged to have the half-phase shifted relationship with respect to one tooth of the cam in the axial direction in a situation where the second cam face on said rotor side is meshed with said second fixed cam face.

* * * * *